United States Patent [19]

Hames et al.

[11] Patent Number: 5,022,094

[45] Date of Patent: Jun. 11, 1991

[54] GRIPPING GLOVE

[76] Inventors: Noel J. Hames, 2908 Wimberly Dr., Apt. 6, Decatur, Ala. 35806; Richard D. Ransom, 1619 Nuby Rd., Hartselle, Ala. 35640

[21] Appl. No.: 358,598

[22] Filed: May 30, 1989

[51] Int. Cl.[5] ..... A41D 19/00

[52] U.S. Cl. ..... 2/161 A; 2/159

[58] Field of Search ..... 2/161 A, 159, 160

[56] References Cited

U.S. PATENT DOCUMENTS

| | | | |
|---|---|---|---|
| 2,083,604 | 6/1937 | 8Hay | 2/161 A |
| 2,751,598 | 6/1956 | Romeo | 2/161 A |
| 3,100,302 | 8/1963 | Billings | 2/161 A |
| 3,105,972 | 10/1963 | Christopher | 2/161 A |
| 3,274,616 | 9/1966 | Russo | 2/161 A |
| 3,348,238 | 10/1966 | Hydock | 2/161 A |
| 3,559,212 | 2/1971 | Skovron | 2/161 A |
| 3,918,097 | 11/1975 | Mlodock | 2/161 A |
| 4,057,255 | 11/1977 | Bishop | 2/161 A |
| 4,643,428 | 2/1987 | Churchill | 2/161 A |
| 4,698,850 | 10/1987 | Patton, Sr. et al. | 2/161 A |
| 4,796,306 | 1/1989 | Mitchell | 2/161 A |
| 4,809,366 | 3/1989 | Pratt | 2/161 A |

FOREIGN PATENT DOCUMENTS

| | | | |
|---|---|---|---|
| 2565213 | 6/1985 | France | 2/161 A |

*Primary Examiner*—Paul T. Sewell
*Assistant Examiner*—Ted Kavanaugh
*Attorney, Agent, or Firm*—Phillips & Beumer

[57] ABSTRACT

A glove for securely retaining an object, such as a racket, in the clenched, gloved hand of a user. The glove includes a strap-like member extending from the fingertips of the glove and disposed for partially wrapping around the wrist of the user. The distal end of the strap is temporarily adhered to the back side of the glove to retain the user's hand in clenched position around the object.

10 Claims, 5 Drawing Sheets

GRIPPING GLOVE

TECHNICAL FIELD

This invention relates generally to gloves and more particularly to a glove having gripping elements thereon to securely grip an object in the user's hand.

BACKGROUND OF THE INVENTION

In tennis games, as in racquetball and other types of games that are played with a racket, the participant is normally faced with the problem of retaining the racket in his hand without losing the racket or having it twist in the hand due to impact with a ball moving at relatively high velocity. In either event, the grip on the racket, and, consequently, the angle of swing, are constantly changing as a result of impact of the racket with the ball, thus resulting in inconsistent games.

Additionally, gripping problems are frequently a result of a person suffering from injury or a stroke. It is not uncommon for a person suffering from a stroke to lose the use of the gripping ability in his or her hands. In order to restore the use of the arms and hands, therapy, including lifting exercises, is often prescribed. However, to participate in such exercises, it is necessary that the afflicted person be capable of gripping and retaining the exercise device (weight, for example) during the exercise period. Such gripping, of course, is not possible by one who has lost use of his or her hands.

Similarly, persons who have lost use of one or both hands are confronted with gripping problems for such daily activities as eating wherein it is necessary that the individual be capable of gripping the eating utensils in order to feed themselves. Without the gripping capability to hold a utensil, other means must be resorted to.

Furthermore, persons (particularly elderly persons) who have lost some gripping power in their hands may find it difficult to perform small tasks or hobbies such as firmly holding garden tools, etc., in their hands while working in the garden. In such cases, the person must give up the pleasure of gardening or device a means of providing the gripping capability to perform the necessary tasks.

Therefore, it is an object of the present invention to provide a glove for securely retaining an object in the user's hand.

It is another object of the present invention to provide such a glove with gripping means for providing a variable predetermined pressure on the gripped object.

It is still another object of the present invention to provide such a glove with such gripping means for releasably securing the object in the user's hand.

It is still another object of the present invention to provide such a glove which will securely retain a racket in a user's hand while preventing angular displacement of the racket even after tremendous impact of the racket with a ball or the like, such as encountered in tennis and racquetball.

These and other objects of the present invention will become more readily apparent from the following description of the drawings taken in conjunction with the accompanying claims.

DESCRIPTION OF THE PREFERRED EMBODIMENT

Figure 1:
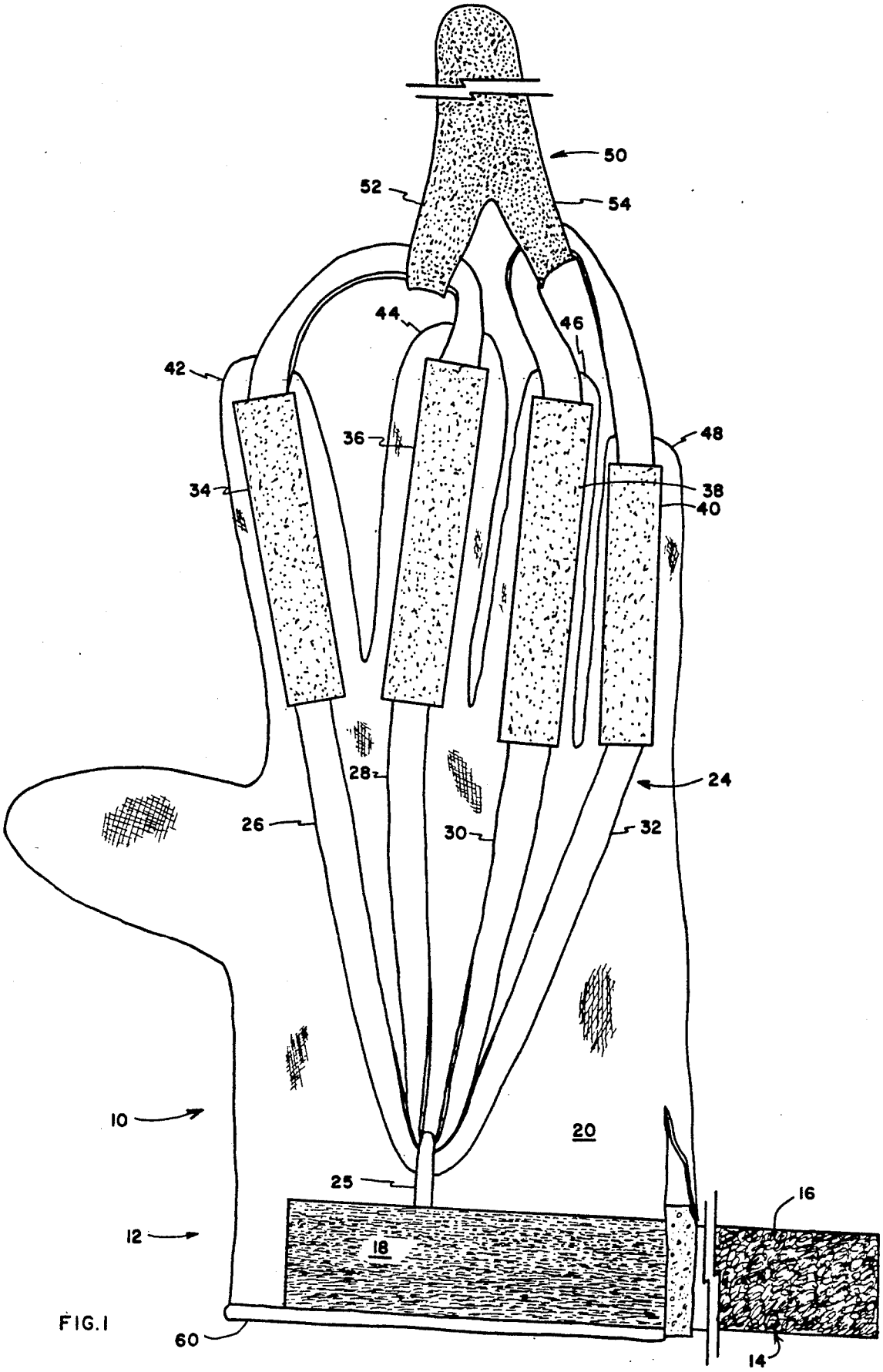
FIG. 1 is a pictorial top view of the glove of the present invention.
Figure 2:
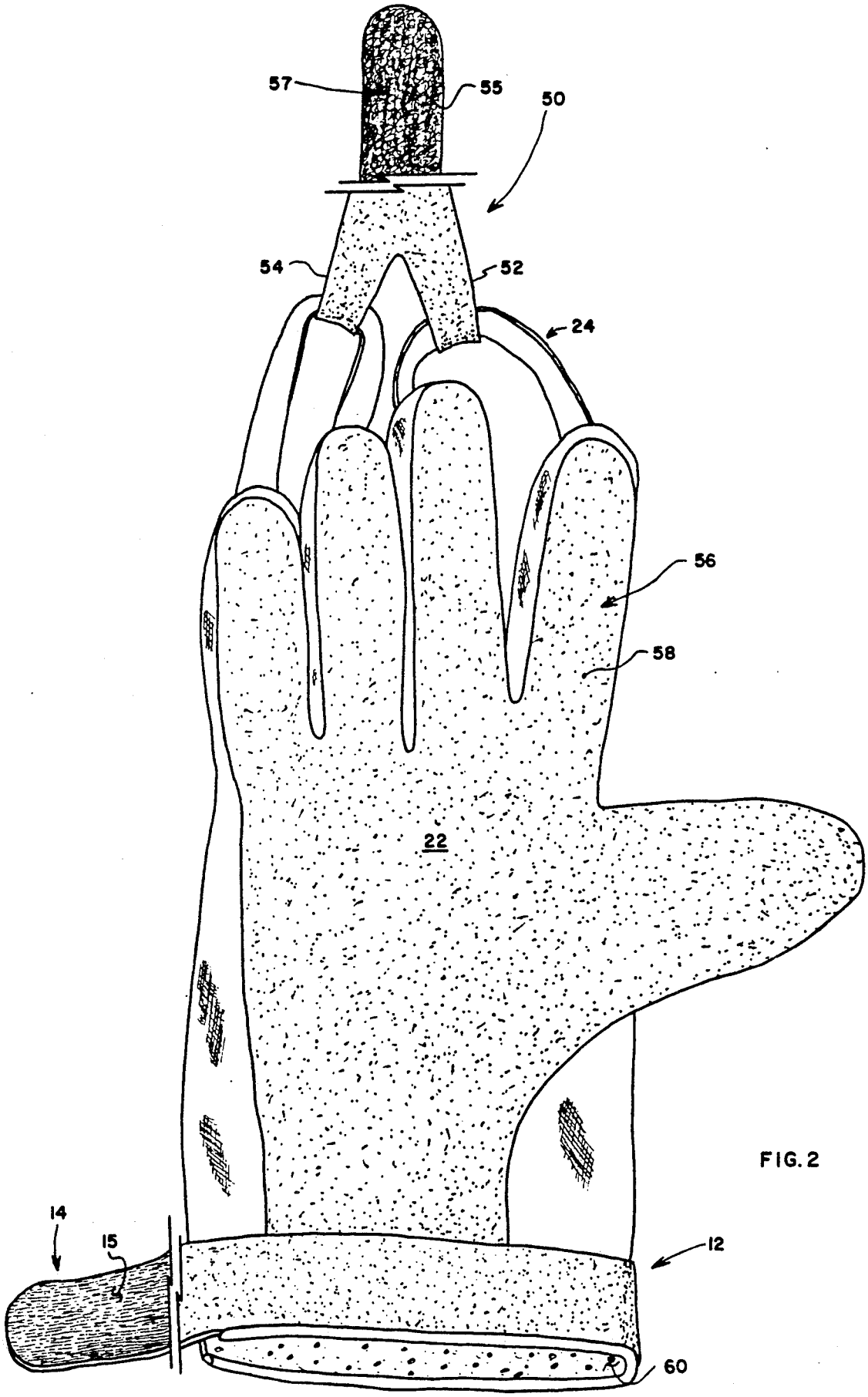
FIG. 2 is a pictorial bottom (palm side) view of the glove of the present invention.
Figure 3:
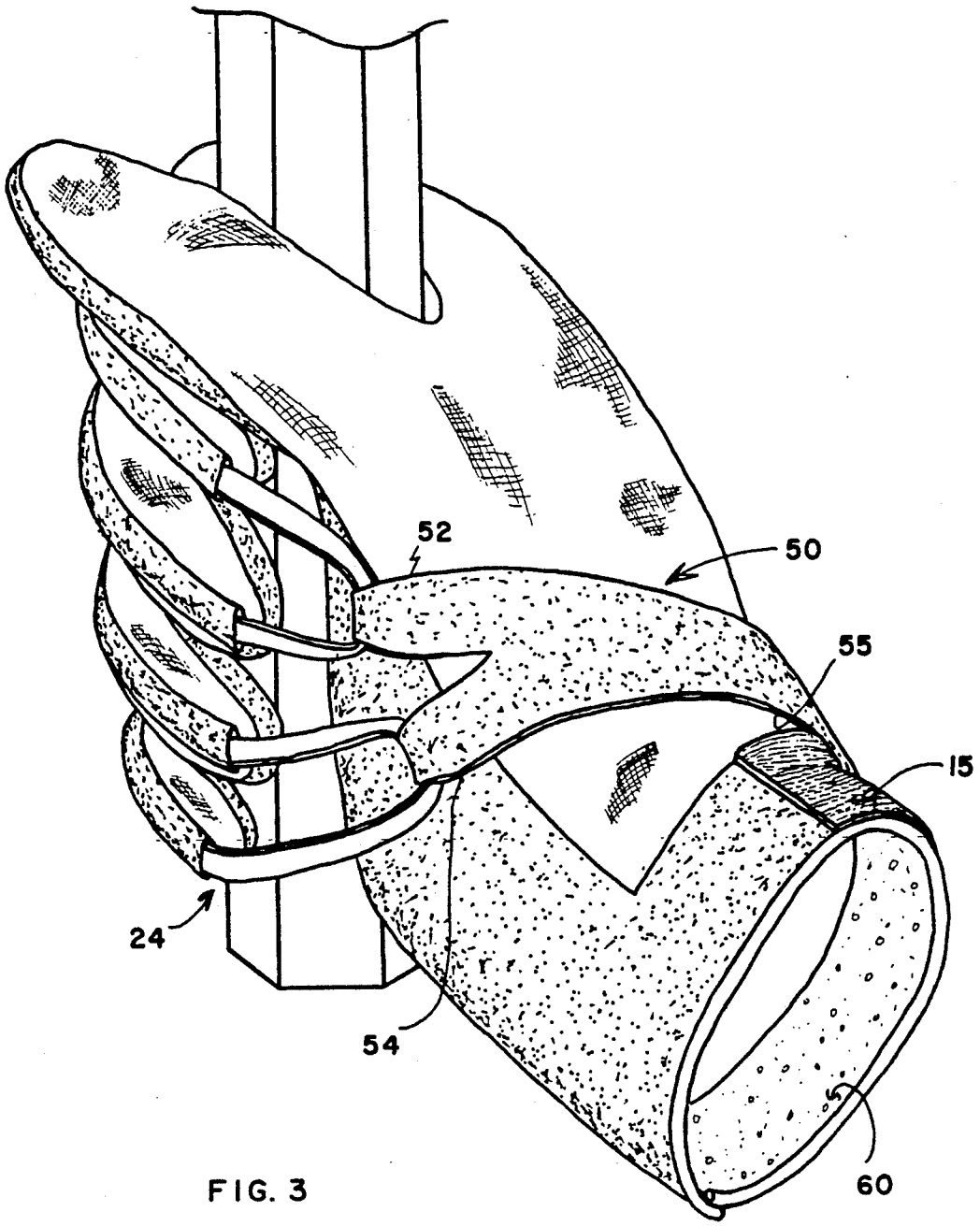
FIG. 3 is a pictorial view of the glove on a user's hand with a racket shown securely held in the gloved hand.

The preferred embodiment of a glove 10 for use by an individual for securely holding an object in his or her hand is shown in FIGS. 1–3. The glove includes a wrist-engaging portion 12 including a strap 14 for securely retaining the glove on the hand of a user. Strap 14 is provided with an inner surface 16 having an adhesive material thereon for adhering to an adhering surface 18 on portion 12 for securing the surface 16 of strap 14 thereto for retaining the glove snugly around the user's wrist. Strap 14 also includes a back surface 15 of adhering material (FIG. 2). Such adhering surfaces are known as VELCRO TM fasteners and include nylon material having a surface of tiny hooks and a complementary surface of a clinging pile.

The glove includes a back side 20 (for the back of the hand) and an inner side 22 (FIG. 2) for the palm or inside of the hand. As seen in FIG. 1, the back side 20 of the glove, which is typically made of SPANDEX TM, is provided with a cord or string-like endless member 24 which is looped through a retainer or loop of material 25 which is secured to the upper portion of the back side 20 of the glove. Cord 24 includes strand portions 26, 28, 30, and 32 which extend through retaining members 34, 36, 38, and 40 which are secured to the finger portions 42, 44, 46, and 48 of the glove. A strap 50 is provided with a pair of eyelets 52 and 54 through which strand portions 26, 28 and 30, 32, respectively, extend to be looped through respective eyelets 52 and 54. A VELCRO TM surface 55 is provided on surface 57 strap 50 (FIG. 2).

As seen in FIG. 2, the palm side 22 of the glove is provided with a surface 56 (such as suede) having tiny perforations 58 therein. The perforations permit ventilation of the hands. Typical gloves being developed now are directed to increasing grip capacity by providing different types of leathers or even stick lubricants, but with suede "the wetter it gets, the better it grips." The wrist portion 12 of the glove is provided with a "sweat" band 60 on its inner surface to absorb perspiration.

FIG. 3 is a pictorial view illustrating the glove on a user's hand and a racket held securely in the gloved hand. As seen in FIG. 3, strap 50 is wrapped around the user's hand with its inner adhering surface 55 secured to the VELCRO TM hook surface 15 of strap 14 at the wrist portion of the glove. In this secured position and with the racket strapped into the user's hand, the racket becomes an extension of the user's hand. Adjustability of the grip relative to fingers 42, 44, and 46, 48 is provided by sliding cord member 24 through loop 26 to either shorten or lengthen that looped end of the cord passing through eyelets 52 or 54.

Figure 4:
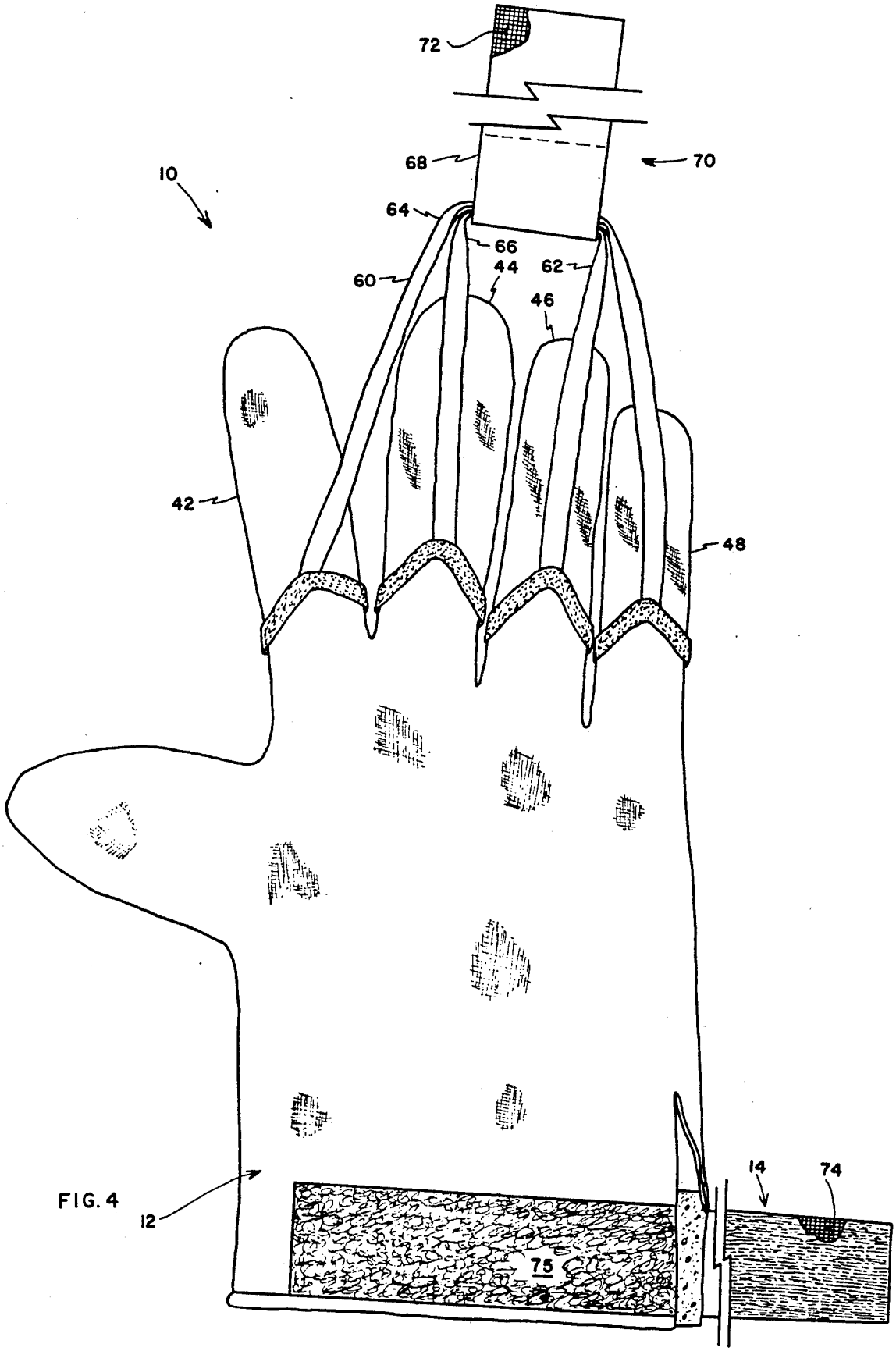
FIG. 4 is a view similar to FIG. 1 illustrating another embodiment of the present invention.

Another embodiment of the invention is illustrated in FIG. 4 wherein like numerals refer to like parts, and wherein a cord member 60 is secured to and extends between fingers 42 and 48 and a second cord member 62 is secured to and extends between fingers 44 and 46. Each of the cord members 60 and 62 are provided with looped ends 64 and 66, respectively, passing through a single eyelet 68 on a strap member 70. A VELCRO TM surface 72 is provided on the inner surface of strap 70 for secured relation with outer VELCRO TM surface 74 of strap 14 when strap 14 is fastened to VELCRO TM surface 75 on the upper portion of the glove.

Figure 5:
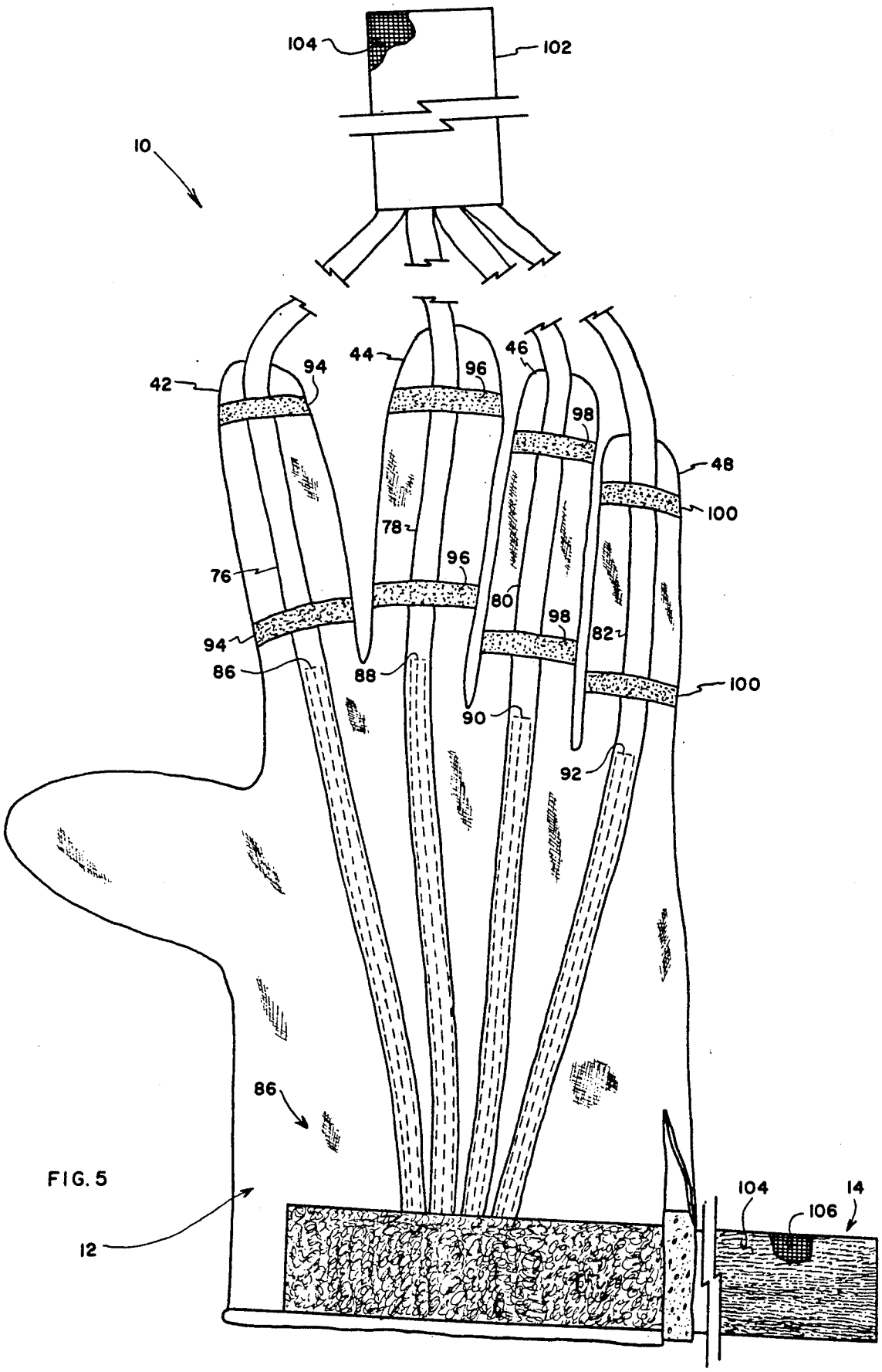
FIG. 5 is a view similar to FIG. 1 illustrating still another embodiment of the present invention.

Still another embodiment of the invention is shown in FIG. 5 wherein cord members 76, 78, 80, and 82 are sewn to the upper back portion 86 of the glove and extend to the finger portions 42, 44, 46, and 48, respectively, of the gloves. The sewn area terminates at portions 86, 88, 90, and 92 of the finger portions 42, 44, 46, and 48, respectively, and the unsewn portions of cords 76, 78, 80, and 82 extend loosely through loops 94, 96, 98, and 100 provided on the fingers. A strap 102 having a VELCRO TM surface 104 on its inner surface may be directly sewn to the distal ends of cords 76, 78, 80, and 84 as shown in FIG. 5, or the ends of cords 76 and 82 along with cords 78 and 80 may be sewn together and passed through an eyelet (in the manner shown in FIG. 4) which may be provided on the end of strap 102. Wrist portion 12 is provided with strap 14 having VELCRO TM surfaces 104 and 106 on opposite sides thereof for secured relation of the glove as shown in FIG. 3.

It is understood that other modifications of the gripping glove may be resorted to, such as providing other types of means for securing the glove on the user's hand (other than the VELCRO TM fasteners). Also, other arrangements of the cord or cords and strap may be relied upon. However, such modifications are within the spirit and scope of the following claims.

We claim:

1. A glove for retention of a user's hand in secured snug-fitting relation around an object, said glove comprising:

a body having back and inner sides, a wrist portion, and extending thumb and finger portions, said inner side including a palm area; and securing means cooperating with said finger portions and said body for retention of said finger portions in secured relation around said object for snug-fitting relation thereof in said palm responsive to a gripped relation of said object by user's hand, said securing means including:

a strap having a first end having eyelet means thereon, said strap disposed in extending relation from said finger portions for secured relation with said body, strap attaching means including a cord member disposed in loosely secured relation with said body and slidably attached to and extending from each said finger portion, said cord member extending through said eyelet means for secured relation with said strap, and a cord retaining member secured to said back portion of said body for the loosely secured relation of said cord thereto, said cord member being continuous and passing loosely, in folded relation, through said cord retaining member, said folded relation providing a cord member having four strand portions, each strand portion being slidably attached to a respective finger portion with a loop portion between adjacent inner and outer finger portions.

2. A glove as set forth in claim 1 wherein said eyelet means includes a pair of eyes, each of said eyes disposed to receive a said loop portion of said cord member loosely therein.

3. A glove as set forth in claim 2 including a sleeve-like member secured to the back side of each said finger portion, said sleeve-like member disposed for said slidably attached relation of said cord member to each said finger portion.

4. A glove as set forth in claim 3 wherein said strap includes a second end having means thereon for secured relation thereof with said body adjacent to said wrist portion.

5. A glove as set forth in claim 1 including wrist attaching means for securing said wrist portion of said glove on the wrist of the user.

6. A glove as set forth in claim 5 wherein said securing means includes adhering surfaces disposed on said body and said strap for secured relation of said strap to said body.

7. A glove as set forth in claim 6 wherein one of said adhering surfaces is disposed on said wrist attaching means and is disposed for adhering to said adhering surface of said strap.

8. A glove as set forth in claim 7 wherein said adhering surfaces are defined by a nylon material having a surface of tiny hooks and a complementary surface of a clinging pile.

9. A glove as set forth in claim 8 wherein said palm side of said glove is made of suede.

10. A glove as set forth in claim 9 wherein said wrist portion of said glove includes an inner surface having a sweat band secured thereto.

* * * * *